US010060230B2

(12) United States Patent
Lopez et al.

(10) Patent No.: US 10,060,230 B2
(45) Date of Patent: Aug. 28, 2018

(54) GRAVEL PACK ASSEMBLY HAVING A FLOW RESTRICTING DEVICE AND RELIEF VALVE FOR GRAVEL PACK DEHYDRATION

(71) Applicant: Halliburton Energy Services, Inc., Houston, TX (US)

(72) Inventors: Jean Marc Lopez, Plano, TX (US); Stephen M. Greci, Little Elm, TX (US); Gregory S. Cunningham, Grapevine, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 304 days.

(21) Appl. No.: 15/023,554

(22) PCT Filed: Oct. 30, 2013

(86) PCT No.: PCT/US2013/067518
§ 371 (c)(1),
(2) Date: Mar. 21, 2016

(87) PCT Pub. No.: WO2015/065373
PCT Pub. Date: May 7, 2015

(65) Prior Publication Data

US 2016/0215595 A1 Jul. 28, 2016

(51) Int. Cl.

| | |
|---|---|
| ***E21B 43/04*** | (2006.01) |
| ***E21B 43/08*** | (2006.01) |
| ***E21B 43/12*** | (2006.01) |
| ***E21B 34/06*** | (2006.01) |

(52) U.S. Cl.
CPC ..... *E21B 43/045* (2013.01); *E21B 34/06* (2013.01); *E21B 43/08* (2013.01); *E21B 43/12* (2013.01)

(58) Field of Classification Search
None
See application file for complete search history.

(56) References Cited

U.S. PATENT DOCUMENTS

| | | | | |
|---|---|---|---|---|
| 5,730,223 | A * | 3/1998 | Restarick | E21B 34/14 166/235 |
| 5,896,928 | A | 4/1999 | Coon | |
| 6,622,794 | B2 * | 9/2003 | Zisk, Jr. | E21B 34/066 166/205 |
| 8,474,535 | B2 * | 7/2013 | Richards | E21B 34/06 166/227 |
| 9,080,421 | B2 * | 7/2015 | Holderman | E21B 34/14 |
| 9,512,702 | B2 * | 12/2016 | Greene | E21B 43/12 |

(Continued)

OTHER PUBLICATIONS

International Search Report and the Written Opinion of the International Search Authority, or the Declaration, dated Jul. 30, 2014, PCT/US2013/067518, 15 pages, ISA/KR.

*Primary Examiner* — Shane Bomar

(57) ABSTRACT

Described herein are gravel pack assemblies capable of performing complete gravel pack jobs when flow restricting devices, such as inflow control devices ("ICD"), are utilized. A gravel pack assembly includes a well screen attached to a flow restricting device and a relief valve. The relief valve is positioned in parallel with the flow restricting device so that the relief valve may provide an alternative path for fluid during dehydration of the gravel pack slurry, thus allowing extra fluid flow through the completion string during the gravel pack operation only.

17 Claims, 4 Drawing Sheets

(56) References Cited

U.S. PATENT DOCUMENTS

| | | | | |
|---|---|---|---|---|
| 2004/0020832 | A1 | 2/2004 | Richards et al. | |
| 2007/0246210 | A1* | 10/2007 | Richards | E21B 43/08 166/56 |
| 2007/0246213 | A1 | 10/2007 | Hailey, Jr. | |
| 2007/0246407 | A1 | 10/2007 | Richards et al. | |
| 2008/0314590 | A1* | 12/2008 | Patel | E21B 34/06 166/278 |
| 2011/0139465 | A1* | 6/2011 | Tibbles | E21B 33/124 166/387 |
| 2012/0090831 | A1 | 4/2012 | Weirich et al. | |
| 2014/0020898 | A1* | 1/2014 | Holderman | E21B 43/08 166/304 |
| 2014/0034308 | A1* | 2/2014 | Holderman | E21B 34/08 166/279 |
| 2014/0262207 | A1* | 9/2014 | Lopez | E21B 34/08 166/114 |
| 2015/0152715 | A1* | 6/2015 | Cunningham | E21B 43/08 166/250.01 |

* cited by examiner

GRAVEL PACK ASSEMBLY HAVING A FLOW RESTRICTING DEVICE AND RELIEF VALVE FOR GRAVEL PACK DEHYDRATION

The present application is a U.S. National Stage patent application of International Patent Application No. PCT/US2013/067518, filed on Oct. 30, 2013, the benefit of which is claimed and the disclosure of which is incorporated herein by reference in its entirety.

FIELD OF THE DISCLOSURE

The present disclosure relates generally to downhole completions and, more specifically, to gravel pack assemblies which utilize a flow restriction device to produce downhole fluids and a relief valve to dehydrate gravel pack slurries.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

Since produced sand is undesirable, a variety of completion techniques have been utilized to address the problem. For example, sand control screens have been utilized to control sand production. However, in addition to the sand control screens, other wells use a gravel pack placed around the screens, which essentially acts as a filter to reduce the amount of fine formation sand reaching the screen, thus controlling sand production. To obtain a complete gravel pack, it is often preferred to fully pack an annulus external to the production tubing across a sand face or external to a sand screen without leaving any voids. Failure to obtain a complete gravel pack can result in lower productivity and/or a sand-producing gravel pack.

Some sand control screens utilize inflow control devices to provide a uniform pressure differential between the flowstream in the tubulars and the reservoir. As a result, a uniform drawdown of fluid along the completion interval is achieved. By using inflow control devices, the reservoir inflow from a high productivity zone can be reduced while improving inflow from a low productivity zone.

However, inflow control devices installed in line with a screen often impede packing of the gravel fully along the length of the screen. Inflow control devices limit the flow rate at which the gravel pack can be pumped, since the flow rate of returns is the same as the flow rate pumped. During gravel packing, the carrying fluid must be removed from the gravel slurry to allow packing of the gravel around the screen. The fluid in the pumped gravel slurry typically follows along the path of least resistance. Thus, the gravel pack liquid flow tends to seek passage through the screen in close proximity to the inflow control device port, thus causing an accumulation of gravel near the port. Once the fluid flow resistance through the gravel accumulating near the port is greater than the fluid flow friction required for flow to enter the next path of lower resistance, the packing process may cease at the prior port and skip to the next port. Often the result is that part of the screen does not have a sufficient gravel pack to the filter formation solids, thus resulting in an incomplete gravel pack.

Accordingly, there is a need in the art for a gravel pack assembly and method which provides the pressure-balancing advantages of an inflow control device, while also providing the fluid flow necessary to form a complete gravel pack.

DESCRIPTION OF ILLUSTRATIVE EMBODIMENTS

Illustrative embodiments and related methodologies of the present disclosure are described below as they might be employed in a gravel pack assembly which utilizes a flow restriction device to produce downhole fluids and a relief valve to dehydrate gravel pack slurries. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments of the present disclosure provide a gravel pack assembly capable of performing an efficient gravel pack job when flow restricting devices, such as inflow control devices ("ICD"), are utilized. In one generalized embodiment, the gravel pack assembly includes a well screen attached to a flow restricting device and a relief valve. The relief valve is positioned in parallel with the flow restricting device so that the relief valve may provide an alternative path for fluid during dehydration of the gravel pack slurry, thus allowing extra fluid flow through the completion string during the gravel pack operation only. The relief valve is rated at a pressure substantially equal to or higher than the pressure necessary to dehydrate the gravel pack slurry.

Therefore, during an illustrative gravel pack operation, the higher pressure differential outside the completion string versus the pressure inside the completion string is utilized to open the relief valve and allow extra fluid flow into the string sufficient to dehydrate the slurry. However, during production, the pressure outside the completion string is no longer high enough to open the relief, thus only allowing produced fluid to travel through the flow restricting device and into the completion string to take returns. Accordingly, the gravel pack assembly provides the pressure-balancing advantages of the fluid restricting device, while also providing the fluid flow necessary to dehydrate the slurry.

Figure 1:
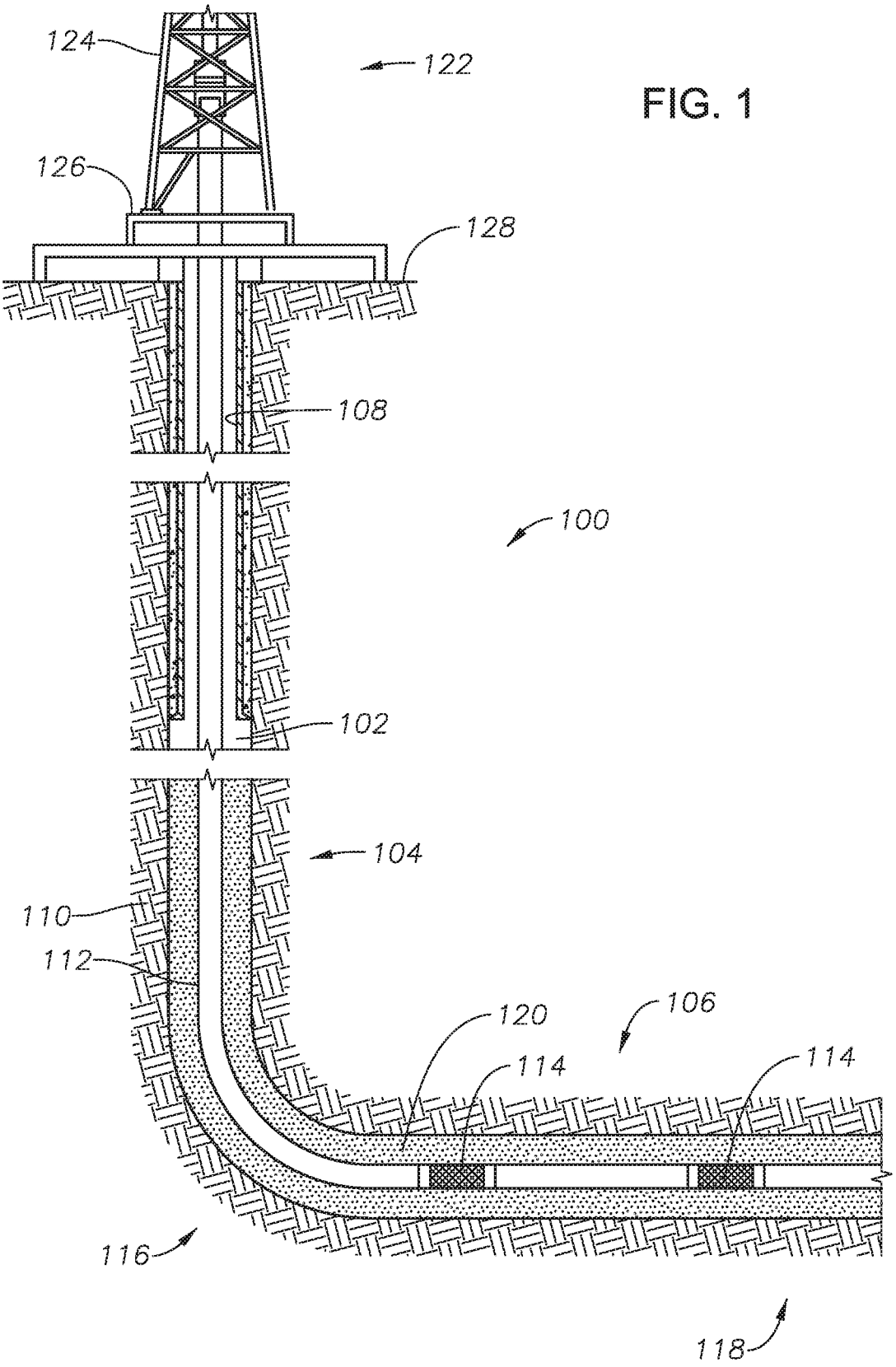
FIG. 1 illustrates a well system utilizing a plurality of gravel pack assemblies, according to certain illustrative embodiments of the present disclosure.

FIG. 1 illustrates a well system utilizing a plurality of gravel pack assemblies, according to certain illustrative embodiments of the present disclosure. Well system 100 comprises a workover and/or drilling rig 122 that is positioned on the earth's surface 128 for the purpose of recovering hydrocarbons. Well system 100 includes a wellbore 102 extending through various earth strata 110, in addition to a plurality of gravel pack assemblies 114 utilized to perform gravel pack operations as described herein. Wellbore 102 has a substantially vertical section 104 and a substantially horizontal section 106. The substantially horizontal section 106 includes a heel region 116 and a toe region 118. The heel region 116 is upstream from the toe region 118. Vertical section 104 includes a casing string 108 cemented at an upper portion of the vertical section 104. In some embodiments, a vertical section may not have a casing string. Nevertheless, horizontal section 106 is open hole and extends through a hydrocarbon bearing subterranean formation (i.e., strata 110). In alternate embodiments, a horizontal section may have casing.

The workover and/or drilling rig 122 may comprise a derrick 124 with a rig floor 126 through which a downhole string 112 (completion string, for example) extends downward from drilling rig 122 into wellbore 102. Workover and/or drilling rig 122 may comprise a motor driven winch and other associated equipment for conveying downhole string 112 into wellbore 102 to position downhole string 112 at a selected depth. While the operating environment depicted in FIG. 1 refers to a stationary workover and/or drilling rig 122 for conveying downhole string 112 within a land-based wellbore 102, in alternative embodiments, mobile workover rigs, wellbore servicing units (such as coiled tubing units), and the like may be used to convey the downhole string 112 within the wellbore 102. A downhole string 112 may alternatively be used in other operational environments, such as within an offshore wellbore operational environment.

Downhole string 112 extends from the surface within wellbore 102. Downhole string 112 can provide a conduit for formation fluids to travel from horizontal section 106 to the surface or for injection fluids to travel from the surface to the wellbore for injection wells. Although not illustrated, downhole string 112 may comprise various tubular types and downhole tools (e.g., zonal isolation devices 118, screens, valves, etc.) necessary to perform a variety of downhole operations. Horizontal section 106 comprises a plurality of gravel pack assemblies 114 as described herein; note, however, that gravel pack assemblies 114 may also be positioned along vertical section 104. Gravel pack assemblies 114 are interconnected to the downhole string 112. A gravel pack 120 may be installed about the gravel pack assemblies 114, as well as throughout a portion of the wellbore 102.

FIG. 1 shows an illustrative portion of a well bore comprising embodiments of the present invention. It should be appreciated that any number of gravel pack assemblies 114 can be employed in a well system. Furthermore, the distance between or relative position of each gravel pack assembly can be modified or adjusted to provide the desired production set up, as will be understood by those ordinarily skilled in the art having the benefit of this disclosure.

Figure 2:
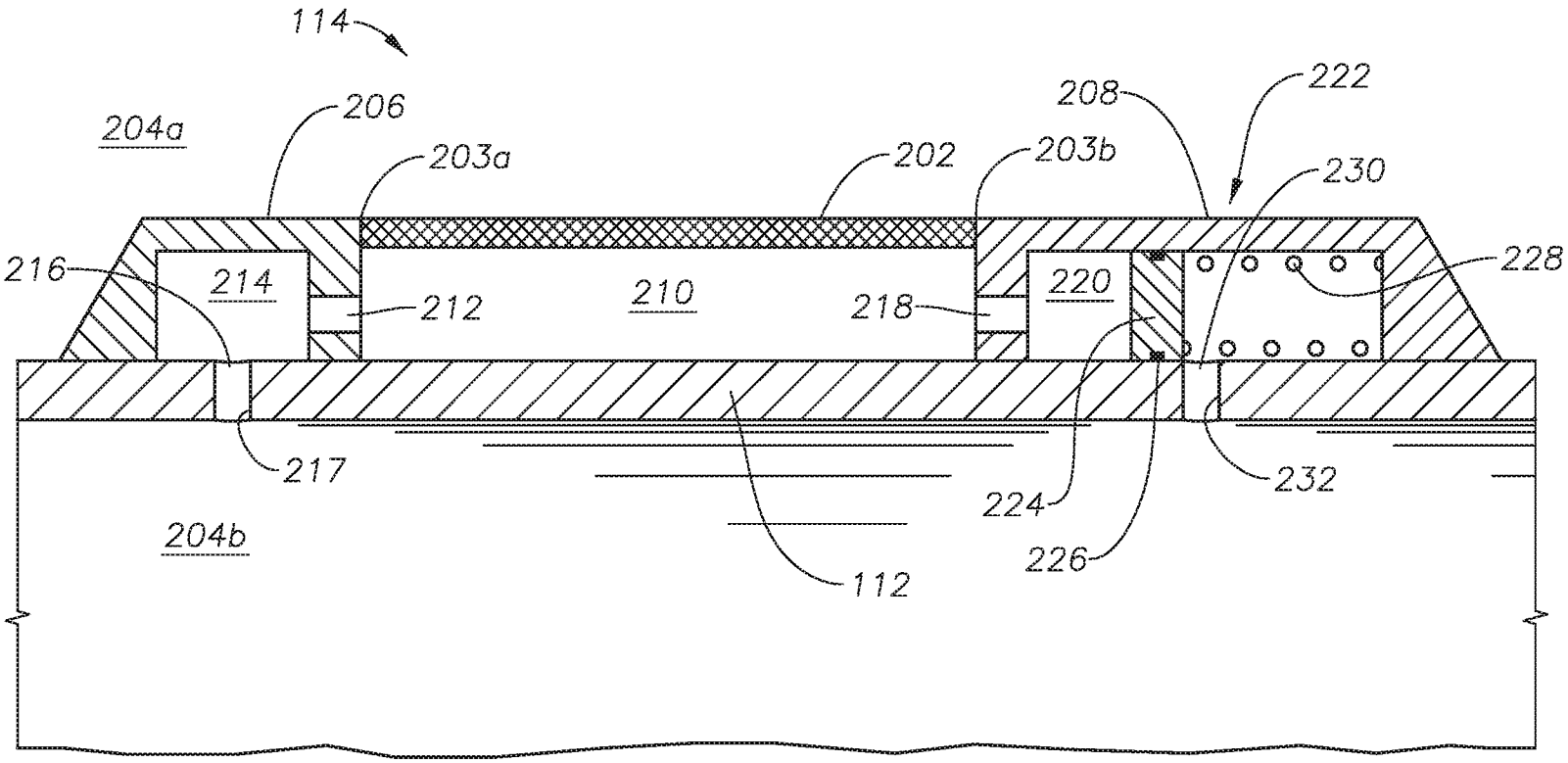
FIG. 2 illustrates a schematic partial cross-sectional view of a gravel pack assembly positioned along a downhole string, according to certain illustrative embodiments of the present disclosure.

Referring now to FIG. 2, a schematic partial cross-sectional view of a gravel pack assembly positioned along a downhole string is provided, according to certain illustrative embodiments of the present disclosure. Gravel pack assembly 114 includes a well screen 202 used to filter at least a portion of any sand and/or other debris from a fluid that generally flows from an exterior 204*a* to an interior 204*b* of downhole string 112. Well screen 202 may be any variety of screens, such as, for example, a wire-wrapped screen made up of a wire closely wrapped helically about a downhole string 112, with a spacing between the wire wraps being chosen to keep sand and the like that is greater than a selected size from passing between the wire wraps. Other types of well screens include, for example, sintered, mesh, pre-packed, expandable, slotted, perforated, as would be understood by those ordinarily skilled in the art having the benefit of this disclosure.

Gravel pack assembly 114 also includes flow restricting device 206 in fluid communication with well screen 202 to thereby control fluid flow through well screen 202. In certain illustrative embodiments, flow restricting device 206 may be an ICD, an adjustable ICD, or an autonomous ICD. In yet other embodiments, flow restricting device 206 can comprise small diameter tubes or channels to restrict inward fluid flow through well screen 202. Flow restricting device 206 may be any device capable of restricting flow, including by using tortuous passages, helical flow paths, nozzles, orifices, and/or other flow restricting elements to restrict inward flow through well screen 202.

Still referring to FIG. 2, the gravel pack assembly also includes a relief valve 208 in fluid communication with well screen 202 to thereby provide an alternative path for fluids during a gravel pack operation, as will be described in more detail below. Flow restricting device 206, well screen 202 and relief valve 208 may jointly form a housing, may be encapsulated inside a housing, or may form part of downhole string 112. Nevertheless, as shown in FIG. 2, flow restricting device 206 is positioned at a first end 203*a* of well screen 202, while relief valve 208 is positioned at a second end 203*b* opposite first end 203*a*, thus forming a fluid passageway 210 between the two. Alternatively, however, flow restricting device 206 and relief valve 208 may be housed within the same housing or otherwise positioned along the gravel pack assembly.

Flow restricting device 206 includes an inlet port 212, in fluid communication with fluid passageway 210, which feeds fluid into a cavity 214. Cavity 214 is also in fluid communication with an outlet port 216 which provides fluid to the bore of downhole string 112 (represented by 204*b*) via port 217. Relief valve 208 in like manner includes an inlet port 218 in fluid communication with fluid passageway 210, to thereby provide fluid to a cavity 220. In this illustrative embodiment, relief valve 208 includes a piston assembly 222 comprising a piston 224 positioned to slidingly seal against the inner surface of cavity 220. An annular seal 226 (elastomeric, for example) is positioned around the outer diameter of piston 224 to prevent fluid from leaking around piston 224.

Piston assembly 222 also includes a spring 228 that provides a biasing force against piston 224. An outlet port 230 of cavity 220 is in fluid communication with the bore of downhole string 226 via port 232. Therefore, the biasing force of spring 228 biases piston 224 to a position with closes off fluid access to port 232. In certain illustrative embodiments, spring 228 is selected to compress at a pressure sufficient to dehydrate the slurry of gravel pack 120. Such pressure may be, for example, 500 psi-1000 psi. Hence, until the pressure differential of exterior 204*a* versus interior 204*b* reaches a sufficient imbalance (500-1000 psi, for example), piston 224 remains in the closed position, thus preventing fluid flow through port 232. Therefore, during production (in which the pressure imbalance would not be sufficient to open relief valve 208, typically 20-100 psi), gravel pack assembly 114 only allows production fluids to flow through flow restricting device 206.

The various ports of gravel pack assembly 114 can be subject to erosion and/or abrasion from fluids passing through them. Accordingly, in certain embodiments, ports 212,216,217,218,230,232, or at least those portions contacting the fluid flow can be formed from any suitable erosion and/or abrasion resistant materials. Alternatively, only port 212 would be erosion resistant, and port 217, 218 and 232 is be large enough to not require erosion resistance since the fluid velocity through this larger area is too slow to cause erosion. Suitable materials may comprise various hard materials such as various steels, tungsten, niobium, vanadium, molybdenum, silicon, titanium, tantalum, zirconium, chromium, yttrium, boron, carbides (e.g., tungsten carbide, silicon carbide, boron carbide), nitrides (e.g., silicon nitride, boron nitride), oxides, silicides, alloys thereof, and any combinations thereof. In an embodiment, one or more of these hard materials may form a portion of a composite material. For example, the hard materials may form a particulate or discontinuous phase useful in resisting erosion and/or abrasion, and a matrix material may bind the hard particulate phase. Suitable matrix materials may comprise copper, nickel, iron, cobalt, alloys thereof, and any combination thereof. Since machining hard, abrasion, erosion and/or wear resistant materials is generally both difficult and expensive, the flow restrictions may be formed from a metal in a desired configuration and subsequently one or more portions of the flow restriction may be treated to provide the desired abrasion, erosion and/or wear resistance. Suitable surface treatments used to provide erosion and/or abrasion resistance can include, but are not limited to, carburizing, nitriding, heat treating, and any combination thereof. In embodiments in which erosion and/or abrasion is not a concern, additional suitable materials such as various polymers may also be used.

Figure 3:
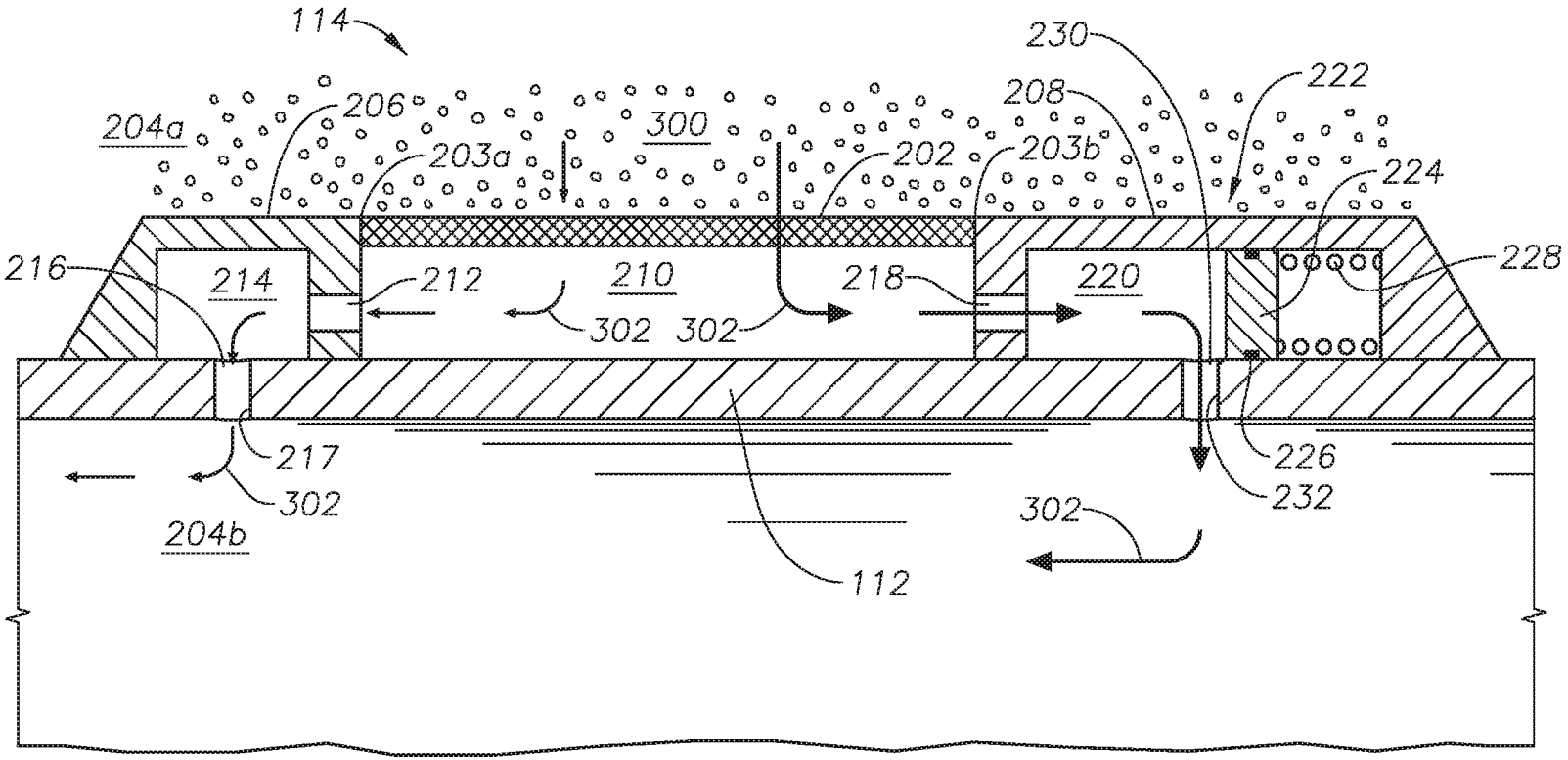
FIG. 3 illustrates the flow of fluid through the gravel pack assembly of FIG. 2 during an illustrative gravel pack operation of the present disclosure.

FIG. 3 illustrates the flow of fluid through gravel pack assembly 114 of FIG. 2 during an illustrative gravel pack operation of the present disclosure. Utilizing one or more of the illustrative embodiments of the gravel pack assemblies described above, an illustrative gravel pack operation will now be described. With reference to FIGS. 1 and 3, after downhole string 112 has been deployed downhole as desired, the gravel pack operation may begin. Any variety of gravel packing methods may be utilized to deliver the slurry downhole, such as, for example, different carrier fluids having different viscosities to transport the gravel may be used (gel or water, for example). Other methods may pump the slurry at different velocities into the well system 100.

Nevertheless, referring to FIG. 3, a sand concentration or gravel pack slurry 300 is first pumped into well system 100 and along the annulus between gravel pack assembly 114 and the casing or wellbore wall, as understood in the art. Gravel pack slurry 300 then flows about well screen 202, where the liquid (identified by arrows 302) in the slurry flows into the openings in well screen 202 (i.e., dehydration). Gravel pack liquid 302 (gel, water, etc.) slowly flows through flow restricting device 206, as it was designed to do. Additionally, however, due to the pumping of gravel pack slurry 300, the pressure differential of the annulus versus the bore of downhole string 112 is high enough that such spring 228 is compressed, thus allowing the opening of relief valve 208 and port 232. As such, fluid 302 is also allowed to flow through relief valve 208 at a rate sufficient to efficiently dehydrate and form a complete gravel pack 120 (shown in FIG. 1).

Figure 4:
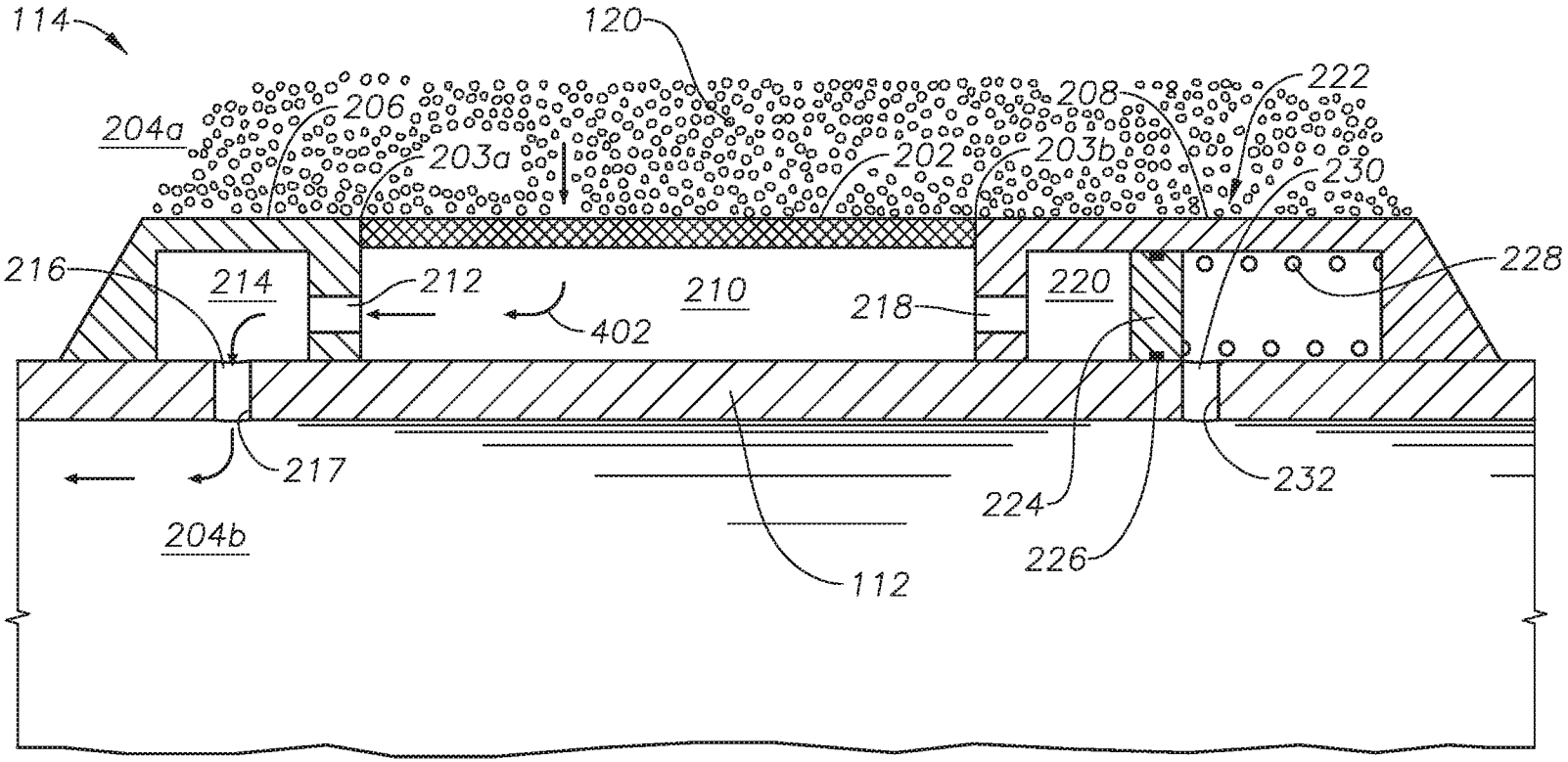
FIG. 4 illustrates the flow of fluid through the gravel pack assembly of FIG. 2 during an illustrative production operation of the present disclosure.

FIG. 4 illustrates the flow of fluid through gravel pack assembly 114 of FIG. 2 during an illustrative production operation of the present disclosure. Now that gravel pack 120 has been formed, production may begin. As understood by those ordinarily skilled in the art having the benefit of this disclosure, the pressure differential between the annulus versus the bore of downhole string 112 is not high enough to compress piston 224. Therefore, since the differential pressure has decreased, spring 228 has forced piston 224 back to the closed position preventing fluid flow through bore 232. Therefore, produced fluids 402 are only allowed to flow through flow restricting device 206, whereby the desired pressure-balancing amongst various zones may be accomplished.

Note that in alternative embodiments, relief valve 208 may be any pressure activate, or non-pressure activated, device, as would be understood by those ordinarily skilled in the art having the benefit of this disclosure. For example, if relief valve 208 were of an intelligent-type design, remote or local processing circuitry may open/close relief valve 208 as desired in order to dehydrate the slurry or produce fluids. Such circuitry may be designed, for example, to cause the actuation upon the sensing of a downhole condition or a signal sent from the surface.

Accordingly, through use of the illustrative embodiments of the present disclosure, the pressure-balancing benefits of inflow control devices are realized, while also providing the fluid flow necessary to complete the gravel pack. As a result, intervention operations can be avoided and completion costs are reduced.

Embodiments described herein further relate to any one or more of the following paragraphs:

1. A gravel pack assembly positioned along a downhole string comprising a well screen; a flow restricting device in fluid communication with the well screen to thereby control fluid flow through the well screen; and a relief valve in fluid communication with the well screen to thereby provide an alternative path for gravel pack fluid during a gravel pack operation.

2. A gravel pack assembly as defined in paragraph 1, wherein the flow restricting device is an inflow control device, an adjustable inflow control device, or an autonomous inflow control device.

3. A gravel pack assembly as defined in any of paragraphs 1-2, wherein the flow restricting device is positioned at a first end of the well screen; and the relief valve is position at a second end of the well screen opposite the first end, thereby forming a fluid passageway between the flow restricting device and relief valve.

4. A gravel pack assembly as defined in any of paragraphs 1-3, wherein the flow restricting device comprises: an inlet port in fluid communication with the fluid passageway; and an outlet port in fluid communication with a bore of the downhole string; and the relief valve comprises: an inlet port in fluid communication with the fluid passageway; and an outlet port in fluid communication with the bore of the downhole string.

5. A gravel pack assembly as defined in any of paragraphs 1-4, wherein the relief valve further comprises a piston in fluid communication with the inlet port of the relief valve;

and a spring that biases the piston in a position which prevents fluid flow through the outlet port of the relief valve.

6. A gravel pack assembly as defined in any of paragraphs 1-5, wherein the relief valve is set to open at a pressure sufficient to dehydrate gravel pack slurry.

7. A gravel pack assembly as defined in any of paragraphs 1-6, wherein the higher pressure is 500 psi-1000 psi.

8. A gravel pack assembly as defined in any of paragraphs 1-7, wherein the relief valve is set to close during production of well fluids.

9. A method for gravel packing a well, the method comprising: deploying a gravel pack assembly along a downhole string, the gravel pack assembly comprising: a well screen;

a flow restricting device in fluid communication with the well screen to thereby control fluid flow through the well screen; and a relief valve in fluid communication with the well screen to thereby provide an alternative path for gravel pack fluid during a gravel pack operation; flowing a gravel pack slurry about the well screen; opening the relief valve; flowing the gravel pack fluid of the gravel pack slurry through the well screen and the relief valve, and into a bore of the downhole string.

10. A method as defined in paragraph 9, wherein opening the relief valve comprises applying a pressure to the relief valve sufficient to dehydrate the gravel pack slurry.

11. A method as defined in any of paragraphs 9-10, wherein flowing the gravel pack slurry further comprises flowing the gravel pack fluid through the flow restricting device.

12. A method as defined in any of paragraphs 9-11, further comprising: closing the relief valve; and producing production fluid through the flow restricting device.

13. A method as defined in any of paragraphs 9-12, wherein closing the relief valve comprises reducing a pressure applied to the relief valve.

14. A method for gravel packing a well, the method comprising: deploying a gravel pack assembly along a downhole string, the gravel pack assembly comprising: a well screen;

a flow restricting device and a relief valve; flowing a gravel pack slurry about the well screen and relief valve; and flowing at least a portion of the gravel pack slurry through the relief valve and into a bore of the downhole string.

15. A method as defined in paragraph 14, wherein flowing at least a portion of the gravel pack slurry through the relief valve further comprises: applying a pressure to the relief valve sufficient to dehydrate the gravel pack slurry; and opening the relief valve in response to the pressure, thus allowing at least a portion of the gravel pack slurry to flow into the bore of the downhole string.

16. A method as defined in any of paragraphs 14-15, further comprising reducing a pressure applied to the relief valve; closing the relief valve in response to the reduced pressure; and producing well fluids through the flow restricting device and into the bore of the downhole string.

17. A method as defined in any of paragraphs 14-16, further comprising flowing at least a portion of the gravel pack slurry through the flow restricting device and into the bore of the downhole string.

18. A method as defined in any of paragraphs 14-17, wherein flowing at least a portion of the gravel pack slurry through the relief valve further comprises opening the relief valve to establish fluid communication into the bore of the downhole string.

19. A method as defined in any of paragraphs 14-18, further comprising closing the relief valve; and producing well fluids through the flow restricting device and into the bore of the downhole string.

20. A method as defined in any of paragraphs 14-19, wherein the flow restricting device is an inflow control device, an adjustable inflow control device, or an autonomous inflow control device.

As used herein, the terms "deviated well" or "highly deviated well" refer to a well or a section of a well that is deviated from a vertical orientation. As used herein, the terms "horizontal well" or "horizontal section of a well" refer to a well or section of a well that is deviated from a vertical orientation in a generally horizontal orientation at an angle from about 60 degrees to about 130 degrees relative to the ground surface. Some embodiments described herein refer to systems, assemblies, or devices that can be utilized in a horizontal well or a horizontal section of well or other wellbores employing screens with flow management devices; although not specifically stated, some of the same such embodiments may be utilized in a deviated or highly deviated well or well section.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A gravel pack assembly positioned along a downhole string, comprising:

a well screen;

a flow restricting device in fluid communication with the well screen to thereby control fluid flow through the well screen; and a relief valve in fluid communication with the well screen and set to open at a pressure sufficient to dehydrate gravel pack slurry to thereby provide an alternative path for gravel pack fluid during a gravel pack operation.

2. A gravel pack assembly as defined in claim 1, wherein the flow restricting device is an inflow control device, an adjustable inflow control device, or an autonomous inflow control device.

3. A gravel pack assembly as defined in claim 1, wherein:
the flow restricting device is positioned at a first end of the well screen; and
the relief valve is position at a second end of the well screen opposite the first end, thereby forming a fluid passageway between the flow restricting device and relief valve.

4. A gravel pack assembly as defined in claim 3, wherein:
the flow restricting device comprises:
an inlet port in fluid communication with the fluid passageway; and
an outlet port in fluid communication with a bore of the downhole string; and the relief valve comprises:
an inlet port in fluid communication with the fluid passageway; and
an outlet port in fluid communication with the bore of the downhole string.

5. A gravel pack assembly as defined in claim 4, wherein the relief valve further comprises:
a piston in fluid communication with the inlet port of the relief valve; and
a spring that biases the piston in a position which prevents fluid flow through the outlet port of the relief valve.

6. A gravel pack assembly as defined in claim 1, wherein the pressure sufficient to dehydrate gravel pack slurry is 500 psi-1000 psi.

7. A gravel pack assembly as defined in claim 1, wherein the relief valve is set to close during production of well fluids.

8. A method for gravel packing a well, the method comprising:
deploying a gravel pack assembly along a downhole string, the gravel pack assembly comprising:
a well screen;
a flow restricting device in fluid communication with the well screen to thereby control fluid flow through the well screen; and
a relief valve in fluid communication with the well screen to thereby provide an alternative path for gravel pack fluid during a gravel pack operation;
flowing a gravel pack slurry about the well screen;
opening the relief valve by applying a pressure to the relief valve sufficient to dehydrate the gravel pack slurry;
flowing the gravel pack fluid of the gravel pack slurry through the well screen and the relief valve, and into a bore of the downhole string.

9. A method as defined in claim 8, wherein flowing the gravel pack slurry further comprises flowing the gravel pack fluid through the flow restricting device.

10. A method as defined in claim 8, further comprising:
closing the relief valve; and
producing production fluid through the flow restricting device.

11. A method as defined in claim 10, wherein closing the relief valve comprises reducing a pressure applied to the relief valve.

12. A method for gravel packing a well, the method comprising:
deploying a gravel pack assembly along a downhole string, the gravel pack assembly comprising:
a well screen;
a flow restricting device and
a relief valve;
flowing a gravel pack slurry about the well screen and relief valve;
flowing at least a portion of the gravel pack slurry through the relief valve and into a bore of the downhole string;
reducing a pressure applied to the relief valve;
closing the relief valve in response to the reduced pressure; and
producing well fluids through the flow restricting device and into the bore of the downhole string.

13. A method as defined in claim 12, wherein flowing at least a portion of the gravel pack slurry through the relief valve further comprises:
applying a pressure to the relief valve sufficient to dehydrate the gravel pack slurry; and
opening the relief valve in response to the pressure, thus allowing at least a portion of the gravel pack slurry to flow into the bore of the downhole string.

14. A method as defined in claim 12, further comprising flowing at least a portion of the gravel pack slurry through the flow restricting device and into the bore of the downhole string.

15. A method as defined in claim 12, wherein flowing at least a portion of the gravel pack slurry through the relief valve further comprises opening the relief valve to establish fluid communication into the bore of the downhole string.

16. A method as defined in claim 15, further comprising:
closing the relief valve; and
producing well fluids through the flow restricting device and into the bore of the downhole string.

17. A method as defined in claim 12, wherein the flow restricting device is an inflow control device, an adjustable inflow control device, or an autonomous inflow control device.

* * * * *